United States Patent [19]

Walsh

[11] 4,182,999

[45] Jan. 8, 1980

[54] REED SPRING RELAY CONSTRUCTION

[75] Inventor: Edward G. Walsh, Galena, Ohio

[73] Assignee: Bell Telephone Laboratories, Incorporated, Murray Hill, N.J.

[21] Appl. No.: 904,973

[22] Filed: May 11, 1978

[51] Int. Cl.[2] ..... H01H 1/66

[52] U.S. Cl. ..... 335/151; 335/154; 335/202

[58] Field of Search ..... 335/151, 152, 154, 202

[56] References Cited

U.S. PATENT DOCUMENTS

| | | | |
|---|---|---|---|
| 2,332,338 | 10/1943 | Peek | 335/154 |
| 3,270,161 | 8/1966 | Turner | 335/151 |
| 3,633,136 | 1/1972 | Walsh | 335/151 |
| 3,639,867 | 2/1972 | Tanimura et al. | 335/154 |
| 3,651,297 | 3/1972 | Jones | 335/151 X |
| 3,928,828 | 12/1975 | Kato et al. | 335/152 X |

*Primary Examiner*—George Harris
*Attorney, Agent, or Firm*—William H. Kamstra

[57] ABSTRACT

An electrical reel spring relay construction in which the winding bobbin serves as the enclosing envelope. The bobbin has a longitudinal cavity therein, the cavity opening at each end of the bobbin in a tapered, wedge-shaped socket. Each spring member of the reed spring member pair has fitted thereabout near its terminal end a wedge-shaped sleeve dimensioned and formed to fit precisely in one of the cavity sockets. As so fitted, the spring members are positioned within the cavity so that their contact ends overlap. A contact gap spacing is determined by slightly oppositely angling the axes of the sockets from the longitudinal axis of the bobbin.

10 Claims, 3 Drawing Figures

REED SPRING RELAY CONSTRUCTION

TECHNICAL FIELD

This invention relates to electromagnetically actuated electrical relays and particularly to such relays having reed spring contacts housed in an enclosing envelope.

BACKGROUND ART

Sealed contact relays are well-known in the electrical arts and have long found extensive application in electrical systems for performing a wide range of switching functions. These relays typically take the form of a pair of reed springs of a magnetically responsive and electrically conductive material suspended at their terminal ends by the envelope of a nonconductive material, usually glass, in which they are sealed. At their other ends the springs overlap and are spaced apart to present a contact gap. A winding encircling the envelope is energizable to generate a magnetic field to create a flux through the reed springs for urging their overlapping ends each toward the other to make electrical contact and thereby to control the electrical circuit in which the relay may be connected.

Although the familiar glass encapsulated reed spring relay has in the past served reliably and well, factors attending its fabrication and employment have prompted continuing efforts to achieve a simpler and sturdier relay construction. These factors include, for example, the realization of a gas-tight bond (if hermetically sealed) between the glass envelope and the retained metal contact springs and the accurate adjustment of the contact gap between the spring ends. The fragility of the bond also demands considerable care in the handling of the relay during installation and maintenance. As a result, a number of alternate reed spring relay structures have been proposed directed to the foregoing and other problems. In one prior art relay arrangement, for example, disclosed by the present inventor in U.S. Pat. No. 3,633,136, issued Jan. 4, 1972, the relay envelope comprises an insulating circular tube open at each end in which opposite ends the reed contact springs are inserted. The spring members are each mounted in a circular plug or cap which is inserted in, or fitted over, the open ends of the tube when the spring members have been fully inserted within the tube in an overlapping relationship.

A tube and end plug reed spring relay arrangement is also disclosed in the patent of W. M. Turner, U.S. Pat. No. 3,270,161, issued Aug. 30, 1966. In these and other broadly similar prior art approaches to relay assembly simplification, the problem of reed spring alignment and contact gap adjustment remains. Circular spring retaining means particularly, for example, may contribute to the difficulty of flat spring alignment contact gap accuracy. Unless the circular retaining means at opposite ends of the enclosing tube are fitted in precise radial alignment, deviation from the parallel of the planes of the overlapping flat springs results. Even a slight misfitting of the circular retaining means at the tube ends may also result in a significant variation from the optimum contact gap spacing. It is thus the problem of simplifying the construction and assembly of a reed spring relay while at the same time ensuring the precision of the relationship of the operating elements that the relay structure of this invention is chiefly directed.

DISCLOSURE OF THE INVENTION

The foregoing general problem and a technical advance is achieved in a reed spring relay construction in which each flat reed spring is fitted near its terminal end with a truncated wedge-shaped sleeve of an electrically nonconductive material fitted or molded thereabout during the spring manufacture. The rectangular base of the sleeve faces the reed spring terminal end. A pair of the reed springs so fitted are inserted into opposite ends of a hollow bobbin on which the relay coil is wound, the bobbin being provided at each end with sockets corresponding in dimensions precisely to those of the wedge-shaped sleeves. As the sleeves are press-fitted into the opposing sockets, the reed springs retained thereby within the bobbin are firmly and permanently held in place without clamps or additional retaining means. When thus fitted into the enclosing bobbin, the springs are dimensioned for a slight overlap at their contact ends. The contact gap spacing is precisely determined by forming the bobbin end sockets so that their axes lie slightly oppositely skewed from the longitudinal axis of the bobbin cavity. The opposite angular deviations extended the lengths of the diverging reed springs thus fix their separation at the overlapping ends and hence the contact gap spacing.

BRIEF DESCRIPTION OF THE DRAWING

The organization and assembly of a reed spring relay construction according to this invention will be better understood from a consideration of the detailed description of one illustrative embodiment thereof which follows when taken in conjunction with the accompanying drawing in which.

DETAILED DESCRIPTION

Figure 1:
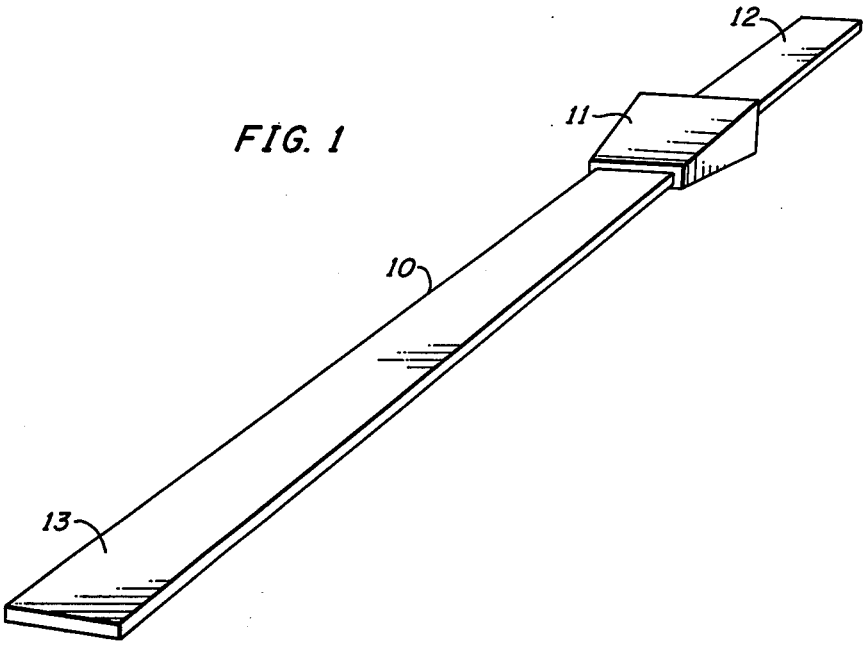
FIG. 1 depicts in perspective view a single reed spring member according to this invention having formed thereon a wedge-shaped retaining sleeve.

A contacting element advantageously adapted for use as a part of a relay assembly according to the present invention is depicted in FIG. 1 and comprises a flat reed spring member 10 formed of a suitable magnetically responsive material. Spring member 10 may be batch fabricated as one of many such members initially formed by stamping from a blank sheet and left attached to a common frame for ease of handling and later severed therefrom as is well-known in the art.

During fabrication of member 10, a wedge-shaped sleeve 11 in the form of a frustrum of a pyramid, the lateral faces of which have a common vertex, is molded about spring member 10 near its terminal end 12. In the embodiment being described, the longer face of the rectangular base of sleeve 11 faces terminal end 12 and lies across the longitudinal axis of spring member 10 and perpendicular to its opposite flat sides so that the attitude of the sleeve pyramid is coaxial with the longitudinal axis of spring member 10. Sleeve 11 may be molded from any suitable plastic, electrically nonconducting material. The contacting end 3 of spring member 10 may be plated with a suitable contacting metal such as ruthenium, also as known in the art.

Figure 2:
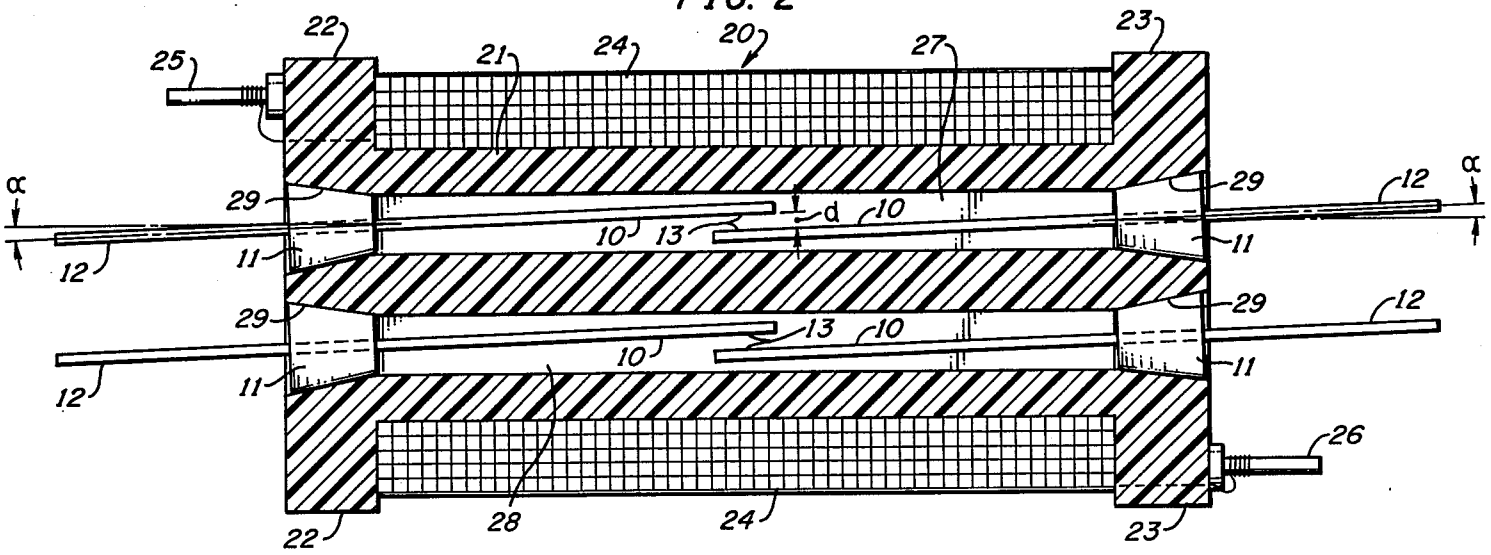
FIG. 2 depicts in longitudinal cross-section the assembly of a multiple relay construction according to this invention.

Two pairs of the contacting elements of FIG. 1 are employed to realize an illustrative, dual path relay assembly 20 as shown in FIG. 2. As there shown in longitudinal cross-sectional view, relay assembly 20 comprises a bobbin 21 molded or otherwise formed of an electrically insulating material having rims 22 and 23 at respective opposite ends to enclose a relay winding 24 wound about bobbin 21. The ends of winding 24 terminate at and are connected to, terminals 25 and 26 mounted on opposite faces of bobbin 21. Bobbin 21 has formed therein a pair of elongated parallel cavities 27 and 28 extending between its opposite faces. Each of the cavities 27 and 28 open at each end in a pyramidal socket 29 which is precisely dimensioned and formed to receive a sleeve 11 of the spring member 10 of FIG. 1. Identical spring members 10 and sleeves 11 (designated in FIG. 2 with the same references characters as in FIG. 1) are inserted at opposite ends within cavities 27 and 28 and opening sockets 29. Sleeves 11 are firmly seated in sockets 29 to achieve a press fit, leaving terminal ends 12 of spring members 10 extending outwardly in each direction from bobbin 21.

In the specific relay embodiment being described, the longitudinal axes of sockets 29 are skewed a slight angle $\alpha$ from the longitudinal axes of cavities 27 and 28 as specifically indicated in connection with cavity 27. Thus, at the rim 22 end of bobbin 21, the axes of sockets 29 deviate downwardly as viewed in the drawing by an angle $\alpha$ from the longitudinal axes of cavities 27 and 28 and upwardly as so viewed by the same angular deviation at the rim 23 end of bobbin 24. The angular deviation $\alpha$ is determined, in relationship with the length of reed spring members 10 extending within a bobbin cavity, to fix precisely the contact gap spacing d between the overlapping contact ends 13 of spring members 10. The cross-section of bobbin 21 as well as its cavities 27 and 28 may be either circular or rectangular as dictated by its ultimate installation requirements and ease of fabrication. Relay 20 is conventionally operated by applying a current source across terminals 25 and 26 to energize winding 24 for generating a magnetic field which, closing through spring members 10, closes the contact gaps at spring ends 13. A relay construction according to this invention thus advantageously not only simplifies assembly and ensures accurate alignment of the operating elements, but also reduces the number of parts by employing the winding bobbin itself as the enclosing envelope.

Figure 3:
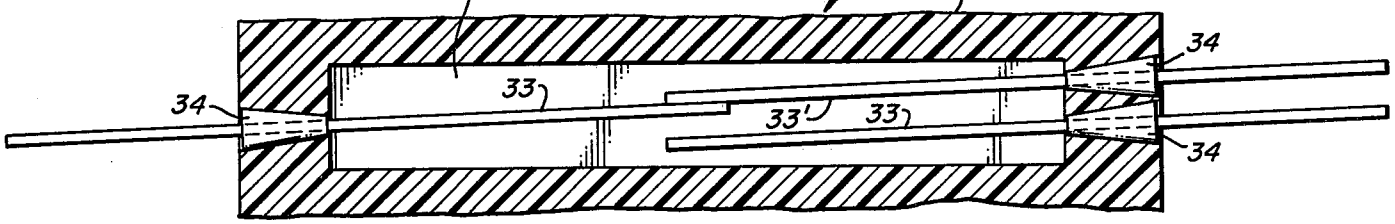
FIG. 3 depicts, also in longitudinal cross-section a portion of an alternate, transfer contact relay construction embodying the principles of this invention.

Another relay construction 30 embodying the principles of this invention is shown in FIG. 3 and comprises a bobbin 31 (a broken portion of which is shown) having a single cavity 32 which in this case may lie coaxially with the longitudinal axis of bobbin 31. Three spring members 33 are arranged within cavity 32 to realize a transfer relay operation. Each of the spring members 33 is fitted with a pyramidal sleeve 34 as described in connection with the relay embodiment of FIGS. 1 and 2, although reduced size to permit a closer spacing of spring members at the double spring end. The sleeves 34 are fitted into corresponding sockets provided therefor at opposite ends of bobbin 31. The transfer relay mode is achieved by the normally closed installation within cavity 32 of the left spring member 33 and the upper right spring member 33'. The lower spring member 33 of the right pair is fitted to present a contact gap with its opposite mate in the manner of the spring members of the relay embodiment of FIG. 2. Both of the opposing spring members 33 are formed of a magnetically responsive material, spring member 33' being formed of a nonmagnetic material. Upon the application of a magnetic field by the energization of an enclosing winding (not shown), the field closes through the open contact spring members 33 causing their closure at the same time opening the contact ends of left spring member 33 and spring member 33'. Upon interruption of the applied field, the spring members are restored to their normal unoperated positions by conventional spring action.

Although in both of the illustrative relay constructions described in the foregoing the mounting of the spring members in the bobbin sockets is permanent and fixed, hermetic sealing of the bobbin cavities was not specifically contemplated. It will be appreciated however, that such sealing for the retention of a suitable atmosphere therein is readily accomplished by a suitable adhesive applied to the spring member sleeves before assembly.

What have been described are considered to be only specific illustrative embodiments of a relay construction according to the principles of this invention. Accordingly, it is to be understood that various and numerous other arrangements may be devised by one skilled in the art without departing from the spirit and scope of the invention as limited only as defined in the accompanying claims.

I claim:

1. An electrical relay construction comprising a winding bobbin having a cavity along its longitudinal axis, said cavity opening at each end in a substantially pyramidal socket, a pair of reed spring members each having a contact end and a terminal end, and a substantially pyramidal sleeve, having the same dimensions as said socket fitted about each of said spring members near said terminal end, said sleeves being fitted in said sockets to position said spring members within said bobbin cavity in an overlapping relationship at said contact ends, said spring members being aligned at slight opposite angles from the longitudinal axis of said cavity to present a contact gap at said contact ends of said spring members.

2. An electrical relay construction as claimed in claim 1 in which the axes of said pyramidal sockets are slightly oppositely angled from said longitudinal axis of said cavity for aligning said spring members at said opposite angles.

3. An electrical relay construction comprising a winding bobbin having a plurality of elongated cavities therein having longitudinal axes lying substantially parallel to the longitudinal axis of said bobbin, each of said cavities opening at its opposite ends in a substantially pyramidal socket, the axes of said sockets at opposite ends of each of said cavities being slightly oppositely angled from the longitudinal axis of a cavity, a plurality of pairs of reed spring members each having a contact end and a terminal end, and a plurality of substantially pyramidal sleeves each having the same dimensions as said sockets fitted respectively about the spring members of said plurality of pairs of reed spring members near the terminal end, said plurality of sleeves being fitted respectively in said sockets at said opposite ends of said plurality of cavities to position said pairs of said spring members within said plurality of cavities in overlapping relationships at the contact ends.

4. An electrical relay construction comprising a winding bobbin having an elongated cavity therein lying along its longitudinal axis, a pair of reed spring members each having a contact end and a terminal end, and a substantially wedge-shaped sleeve fitted about each of said spring members near said terminal end, said cavity opening at each end in a socket dimensioned to receive said wedge-shaped sleeve, said sleeves of said spring members of said pair of spring members being fitted in said sockets at opposite ends of said cavity to position said spring members within said cavity in an overlapping relationship at said contact ends.

5. An electrical relay construction as claimed in claim 4 in which the axes of said sockets are slightly and oppositely angled from the longitudinal axis of said cavity to present a contact gap at the contact ends of said spring members.

6. An electrical relay construction as claimed in claim 4 in which said sockets and said sleeves are formed in the shape of equally dimensioned, truncated pyramids.

7. An envelope for an electrical reed spring relay comprising a bobbin for retaining the winding of said relay, said bobbin having an elongated cavity lying substantially parallel to the longitudinal axis of said bobbin, said cavity opening at each side of said bobbin in a substantially wedge-shaped socket adapted to receive an equally dimensioned wedge-shaped sleeve for retaining the reed spring members of said relay.

8. A contacting member for an electrical relay comprising a reed spring having a contact end and a terminal end and a wedge-shaped sleeve fitted about said reed spring near said terminal end, said sleeve having a rectangular base facing said terminal end, said sleeve being adapted to fit into an equally dimensioned and shaped socket provided in a housing for said relay.

9. An electrical relay construction comprising a winding bobbin having an elongated cavity therein lying substantially parallel to its longitudinal axis, a first and second reel spring member of a magnetically responsive material, a third reed spring member of a non-magnetic material, each of said spring members having a contact end and a terminal end, a substantially wedge-shaped sleeve fitted about each of said spring members near said terminal end, said cavity opening at one end of said bobbin in a first wedge-shaped socket dimensioned and formed to receive said wedge-shaped sleeve, said cavity opening at the other end of said bobbin in a second and third wedge-shaped socket dimensioned and formed identically to said first socket, said sleeves of said first and second spring members being fitted in said first and second sockets, respectively, to position said first and second spring members within said cavity in an overlapping relationship at said contact ends, said sleeve of said third spring member being fitted in said third socket to position said third spring member within said cavity in an overlapping relationship with said first spring member at said contact end, said first and second sockets being slightly oppositely angled from the parallel to said longitudinal axis to present a contact gap at the contact ends of said first and second spring members, said third socket being positioned so that the contact ends of said first and third spring members are in contact.

10. An electrical relay construction comprising a bobbin (FIGS. 2, 21) for retaining the winding (24) of said relay and at least a pair of reed spring members (FIGS. 1 and 2, 10) each having a contact end (13) and a terminal end (12), said spring members being arranged in an overlapping relationship to present a contact gap (d) at their contact ends characterized in that said bobbin (21) is provided with an elongated cavity (FIGS. 2, 27) lying substantially parallel to the longitudinal axis of said bobbin, each of said spring members (10) has fitted thereabout a substantially wedge-shaped sleeve (11) near its terminal end, and in that said cavity (27) opens at each end of said bobbin (21) in a wedge-shaped socket (FIGS. 2, 29) dimensioned to receive said sleeve (11), said sleeves (11) being fitted, respectively, in said sockets (29) to position said spring members within said cavity in said overlapping relationship, the axes of said sleeves (11) being slightly oppositely angled from the parallel to said longitudinal axis of said bobbin (24) to determine said contact gap (d).

* * * * *